US007594561B2

(12) United States Patent
Hass et al.

(10) Patent No.: US 7,594,561 B2
(45) Date of Patent: Sep. 29, 2009

(54) MINE PROTECTION VEHICLE SYSTEM

(75) Inventors: Frank Hass, Wendtorf (DE); Eitel Runow, Bonebuttel (DE); Manfred Krutzfeldt, Krusendorf (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 243 days.

(21) Appl. No.: 11/055,029

(22) Filed: Feb. 11, 2005

(65) Prior Publication Data

US 2005/0257679 A1 Nov. 24, 2005

(30) Foreign Application Priority Data

Feb. 11, 2004 (DE) ..... 10 2004 006 819

(51) Int. Cl.
*B60P 7/16* (2006.01)

(52) U.S. Cl. ..... 180/299; 180/89.13; 296/190.04

(58) Field of Classification Search ..... 180/208, 180/299, 89.13; 296/190.04, 1.03
See application file for complete search history.

(56) References Cited

U.S. PATENT DOCUMENTS

| | | | | |
|---|---|---|---|---|
| 2,716,040 | A * | 8/1955 | Barenyi | 296/193.01 |
| 4,031,807 | A * | 6/1977 | Boyer | 89/36.13 |
| 4,280,393 | A * | 7/1981 | Giraud et al. | 89/36.08 |
| 4,351,558 | A | 9/1982 | Mueller | |
| 4,368,793 | A | 1/1983 | Igarashi | |
| 4,422,685 | A * | 12/1983 | Bonfilio et al. | 296/193.04 |
| 4,492,282 | A * | 1/1985 | Appelblatt et al. | 180/68.1 |
| 4,534,267 | A | 8/1985 | Fagel | |
| 4,676,545 | A * | 6/1987 | Bonfilio et al. | 296/193.04 |
| 4,842,326 | A * | 6/1989 | DiVito | 296/193.04 |
| 4,878,451 | A | 11/1989 | Siren | |
| 4,881,756 | A | 11/1989 | Kumasaka et al. | |
| 5,176,213 | A | 1/1993 | Kawai et al. | |
| 5,245,738 | A | 9/1993 | Johnson | |
| 5,401,056 | A * | 3/1995 | Eastman | 280/785 |
| 5,558,588 | A | 9/1996 | Schmidt | |
| 5,663,520 | A * | 9/1997 | Ladika et al. | 89/36.08 |
| 5,738,378 | A * | 4/1998 | Yazejian | 280/784 |
| 5,866,839 | A | 2/1999 | Ohayon et al. | |
| 5,934,397 | A * | 8/1999 | Schaper | 180/65.2 |

(Continued)

FOREIGN PATENT DOCUMENTS

| | | |
|---|---|---|
| DE | 25 27 100 | 2/1976 |

(Continued)

OTHER PUBLICATIONS

Office Action in corresponding German Patent Application No. 10 2004 006 819.4-15, dated Feb. 2, 2005.

(Continued)

*Primary Examiner*—Jeffrey J Restifo

(57) ABSTRACT

A mine protection vehicle system is proposed wherein a military wheeled vehicle is provided with a high degree of mine protection. Preferably the vehicle has a three-sectioned vehicle construction that includes a front building block, a main building block and rear building block. The building blocks are separable from one another. The main building block may be designed to be slanted toward the bottom and double walled. A cabin, serving to provide a crew space, is hung up on support structure of the main building block. Wheel axles and drives are built into the front and/or rear building block; however, no wheel axle is disposed below the main building block.

12 Claims, 4 Drawing Sheets

U.S. PATENT DOCUMENTS

| | | | | |
|---|---|---|---|---|
| 6,216,807 | B1 | 4/2001 | Eckhoff | |
| 6,363,830 | B1 * | 4/2002 | Gonzalez | 89/36.01 |
| 6,435,071 | B1 * | 8/2002 | Campbell | 89/36.08 |
| 6,617,703 | B2 | 9/2003 | Matsubara et al. | |
| 6,658,984 | B2 * | 12/2003 | Zonak | 89/36.08 |
| 6,779,431 | B2 | 8/2004 | Honlinger | |
| 6,817,655 | B2 * | 11/2004 | Durand | 296/193.03 |
| 6,892,621 | B2 * | 5/2005 | Grosch | 89/1.11 |
| 6,896,319 | B1 * | 5/2005 | Huang et al. | 296/193.04 |
| 7,007,761 | B1 | 3/2006 | Johnson, IV | |
| 7,228,927 | B2 | 6/2007 | Hass et al. | |
| 2005/0284682 | A1 * | 12/2005 | Hass et al. | 180/242 |

FOREIGN PATENT DOCUMENTS

| | | | |
|---|---|---|---|
| DE | 31 19 786 | A1 | 12/1982 |
| DE | 32 06 794 | A1 | 9/1983 |
| DE | 37 19 289 | C1 | 12/1988 |
| DE | 19718709 | | 11/1997 |
| DE | 196 31 715 | A1 | 2/1998 |
| DE | 196 53 283 | C1 | 6/1998 |
| DE | 196 19 865 | C2 | 7/1999 |
| DE | 199 41 928 | C2 | 10/2002 |
| DE | 102 33 274 | A1 | 2/2004 |
| DE | 102 59 918 | A1 | 7/2004 |
| EP | 1120625 | A2 * | 8/2001 |
| FR | 2276552 | | 1/1976 |
| FR | 2510737 | | 2/1983 |
| WO | 02/47958 | | 6/2002 |

OTHER PUBLICATIONS

European Search Report in corresponding European Patent Application No. 04 02 9760, dated Mar. 21, 2005.

H.P. Willmott's Book, "World War I," published in Great Britain by Dorling Kindersley Limited, 2003. (Exhibit A).

* cited by examiner

MINE PROTECTION VEHICLE SYSTEM

The present application claims priority under 35 U.S.C. § 119 to German Application No. DE 10 2004 006 819.4, the entire disclosure of which is incorporated herein by reference.

FIELD OF THE INVENTION

The invention relates to a vehicle equipped with protection against the effect of a land mine explosion. In particular, the present invention relates to an armored wheeled vehicle for generally protecting personnel, as well as the vehicle housing in the armored vehicle, against the effect of explosions of mines located in or on the ground.

BACKGROUND OF THE INVENTION

Armored personnel vehicles have, as a rule, a flat under-carriage and a sufficiently high clearance between the under-carriage and ground. This high clearance is secured by properly constructing the gear or chain drive works so that the vehicle can move unhindered even on cross country terrain. Unfortunately, the explosive through-effect of a shock wave from a mine exploding under the vehicle impacts on the relatively large surface area of the vehicle's broad under-carriage or under-pan, which deforms and damages the under-carriage and can cause significant damage inside the vehicle as well.

Previously, the following devices and principles for mine protection have been designed with respect to the under-pan.

The simplest precaution, or protective measure, is to provide the under-pan with a secure sheet thickness that protects or shields against a given mine charge. This solution, however, results in a large amount of weight added to the vehicle, which can have its own disadvantageous affects.

Another possibility for protecting against the explosive effect of a land mine lies in constructing the floor plate of a pan to include a sandwich plate made up of various superimposed materials. Such a sandwich plate pan construction is secure and provides protection against a given mine charge. In addition, the floor structure of the pan can be designed with superimposed plates and spaces, for example, air layers, so that the upper most plate experiences no or very little denting as a result of a given mine charge detonating underneath the vehicle.

According to the state of the art, various other proposals for avoiding damage from shock waves generated by, and moving from, exploding mines have been made.

From German Document DE 31 19 786, it is known to place flat armor elements on the underside of the vehicle to protect against mines. In German Document DE 196 31 715, the reference teaches equipping the vehicle floor with a deflector, shaped as a wedge with respect to the floor. This deflector can also be equipped with a gas generator for inflating a fillable gas sack supported from inside of the deflector. This fillable gas sack provides a counter action against the explosion, thereby providing the vehicle with additional protection against landmines.

In German Document DE 196 53 283, a space cell is elastically suspended separately within the vehicle housing to provide a crew space that overcomes some of the shock effects acting on the vehicle from the outside of the vehicle when a landmine explodes nearby.

In further applications of armored vehicles, deformation bodies are provided on the vehicle floor in order to minimize the pressure effect of mines impacting on the under-carriage of the vehicle.

In German Document DE 199 41 928 C2, a street and cross-country-terrain-suitable vehicle (i.e., an all terrain vehicle), particularly a military wheeled vehicle, is described that includes several separateable modules. The base housing is designed as a central carrying unit and contains the internal combustion motor, spaces for necessary cargo uptake (i.e., cargo holds), and serves as the passenger cell. Underneath the base housing, there is a drive stool that takes up the intermediate drive between the motor and the motor's transmission and the wheels.

Unpublished German Document DE 102 59 918.1, which corresponds to U.S. patent application Ser. No. 10/739,947 to Grosch, describes providing a mine protection device, particularly for wheeled vehicles, in which a detection signal from an ignition and calculation unit is sent out in response to a detected shockwave/compression wave or blast wave. The ignition and calculation unit is connected to a pyrotechnic separation element, and the sending of the detection signal to the pyrotechnic separation element leads to the separation of a wheel construction group, or just the wheel, of the vehicle structure. The pyrotechnic separation of the wheel carrying support structure can take place by using a separation charge, or by using a suitable construction having a separation point with pyrotechnical separation screws. U.S. patent application Ser. No. 10/739,947 to Grosch is incorporated herein by reference in its entirety.

It is an object of the present invention to provide a suitable protection system that provides an improvement in protection against the effects of an exploding mine using a simple and robust construction to protect the crew of an armored vehicle. It is a further object of the present invention to provide the greatest possible protection against mine explosions, especially against blast mines, by adapting a combination of multiple protection solutions in a single vehicle.

BRIEF SUMMARY OF THE INVENTION

These objects are solved, according to the present invention, by the features of one embodiment of the invention, which is an armored wheeled vehicle with protection against effects of a land mine, including: (a) a plurality of building blocks separating and dividing the vehicle, wherein the plurality of building blocks include: (i) at least one main building block; (ii) a front building block; and (iii) a rear building block, wherein the front building block is separably connected by a first means for connecting to a front portion of the main building block and the rear building block is separably connected by a second means for connecting to a rear portion of the main building block; and (b) a plurality of wheel axles disposed to rotate on one or more of the plurality of building blocks, wherein no wheel axle is disposed below the main building block.

In another embodiment of the present invention, the first means for connecting and the second means for connecting each comprise one or more bolts having target break points. In yet another embodiment of the present invention, the first means for connecting and the second means for connecting comprise one or more exploding bolts, each bolt comprising a built-in charge for igniting and blowing off the bolt. In still another embodiment of the present invention, the vehicle further includes a plurality of wheels connected to each wheel axle, wherein the vehicle is constructed so a free space is located at 90° upwards, above the wheels of each wheel axle.

In another embodiment in accordance with the present invention, the main building block has a V-shaped floor. In accordance with yet another embodiment of the present invention, the main building block has a pan housing, and the pan housing includes a double walled structure and a thin steel plate. In accordance with still another embodiment of the present invention, the pan housing further comprises a high profile.

In another embodiment of the present invention, the main building block includes a first cabin hung into, and vibrationally decoupled to, a housing portion by a plurality of elastic hangers. In still another embodiment of the present invention, the housing portion includes a plastically deformable carrier support structure. In yet another embodiment of the present invention, the main building block includes one or more first doors, wherein each first door is flapped down in an open position to provide a step support. In yet another embodiment of the present invention, the front building block has a front axle connected to rotate on the front building block and a steering assembly connected to steer wheels connected to the front axle. In accordance with still another embodiment of the present invention, the front building block includes a drive motor operably connected to drive the front axle. In accordance with another embodiment of the present invention, the rear building block includes a rear axle connected to rotate on the rear building block. In yet another embodiment of the present invention, the rear building block comprises a drive motor operably connected to drive the rear axle.

In another embodiment, in accordance with the present invention, the first cabin includes thick walled soft aluminum material. In still another embodiment of the present invention, a first space for a drive shaft or for cables is constructed inside the main building block, wherein the first space is located between a V-shaped floor of a support structure of the main building block and a flat-bottomed portion of the first cabin. In another embodiment in accordance with the present invention, the vehicle is reconfigureable by unhanging the first cabin and hanging in a second cabin in place of the first cabin thereby reconfiguring the vehicle.

Thus, according to the present invention, a vehicle is subdivided into several building blocks, for example, three building blocks, that are connected to one another in a separable manner. Such a vehicle, in accordance with the present invention and for achieving an improved protective effect against the damaging effects of mines, includes a central building block (also called the "main building block"), as well as a front building block and a rear building block. The rear building block and front building block are flanged onto portions of the middle building block, or releasably fastened thereto, by means of exploding bolts (i.e., bolts manufactured with a built-in charge) and/or bolts that have target break points. The exploding bolts are ignited by means of a built-in charge and can thereby be blown off when a shock wave generated by an exploding mine impacts a wheel of the vehicle. The connection of the building blocks to each other can be alternatively achieved using bolts with target break points, or a combination of exploding bolts and bolts with target break points can be used. The wheel axles of the vehicle, in accordance with the present invention, are so spaced that they do not lie under the crew space building block.

The actual crew space, in accordance with the present invention, is hung as a cabin or protection cell in the vehicle housing of the main building block and is vibrationally decoupled to the housing. The carrying structure is made to be plastically deformable, and the V-shaped underbody is constructed without breaks (i.e., doors) that could permit explosive energy to travel into the cabin and crew space. This construction of the main building block results in an elastic suspension of the cabin in the region of the roof of the main building block, which serves to hinder the transmission of, and to dissipate, shock wave energy from a mine explosion. Furthermore, the main building block is constructed to include plastically deformable energy absorbing thin walled hollow profiles so as to provide an additional energy dissipating structure.

On the front building block, the front axle is rotatably disposed. In addition to the front axle, the front building block is provided with a steering mechanism or assembly for steering the wheels connected to the front axle. Furthermore, the front building block is provided with its own drive motor that is connected to rotate and drive the front axle. On the rear building block, the rear axle is rotatably disposed. The rear building block can, in addition to the rear axle, also include its own drive motor that is connected to rotate and drive the rear axle. This dual motor construction has the advantage that a front motor and a rear motor can be used at the same time to drive the vehicle, thereby providing a powerful redundant drive. In addition, the dual motor construction provides and secures a supplementary mobility for the vehicle, which is the ability of the vehicle to operate the remaining drive motor, after the other drive motor has been blown off by an exploding mine, to drive the vehicle out of the danger zone and into safety.

A space formed inside of the main building block, between the V-shaped bottom of the support structure and the flattened lower portion of the cabin, can serve to contain a drive shaft and/or cables.

The advantages of certain embodiments of the mine protection vehicle system, in accordance with the present invention, all lie in the high degree of mine protection provided for the crew. This high degree of mine protection is achieved by the following features when applied alone or together in combination: (i) the V-shaped floor, (ii) the free space above the wheels (i.e., higher placed wheel boxes or missing wheel boxes), (iii) a plastically deformable high profile for the support structure, (iv) the double-walled pan housing made of thin sheet steel, (v) a security cell for the crew made of thick walled light metal, and (vi) the coupling of the security cell in the roof region of the support structure so as to decouple the transmission of energy from a mine explosion to the security cell containing the crew. Thus, the building blocks are so constructed that mine explosions have as minimal damaging effects as possible.

Furthermore, it is possible by simply unhanging one cabin to reconfigure the vehicle of the present invention by simply hanging on another cabin in the main building block. This interchangeable structure simplifies the re-equipping of the main building block to include a cabin that transforms the vehicle into a new version of the vehicle. For example, a vehicle required for scouting missions may be equipped with a cabin configured for scouting missions, whereas a cabin used for crowd control and disbursement may replace the scouting cabin, thereby reconfiguring a scouting vehicle into a vehicle suitable for military police missions.

Other objects, features and advantages of the present invention will become apparent from the Detailed Description of Illustrative Embodiments, which follows, when considered together with the attached drawings.

BRIEF DESCRIPTION OF DRAWINGS

The illustrative embodiments of the invention are schematically represented in the drawings and are more closely described as follows.

DETAILED DESCRIPTION OF INVENTION

Figure 1:
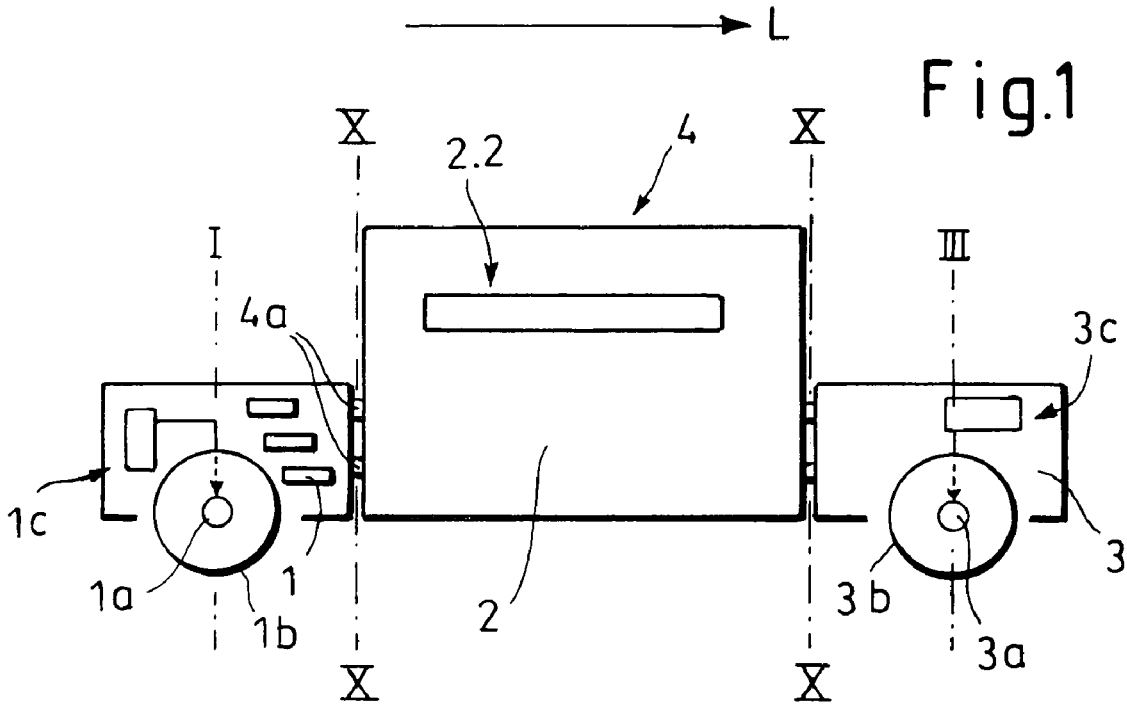
FIG. 1 shows a schematic side view of a vehicle embodiment in accordance with the present invention.

The non-limiting apparatus embodiments of the present invention are described with reference to the Figures, wherein like parts are numbered by like reference numbers. Vehicle 4, shown from the side in FIG. 1, is constructed to include a front building block 1 (also referred to herein as the "motor building block"), which has a wheel axel 1*a* rotatably connected thereto and wheels 1*b* (only one shown) connected to the front axle 1*a*. Vehicle 4 also includes a main building block 2 (also referred to herein as the "crew space building block") and no wheels are located on or below the crew space building block 2 for reasons that will be described in detail later on. The vehicle 4 also includes a rear building block 3, which has a wheel axel 3*a* rotatably connected thereto and wheels 3*b*. The crew space building block 2 includes one or more doors 16 through which a crew enters and exits the vehicle 4.

Figure 5:
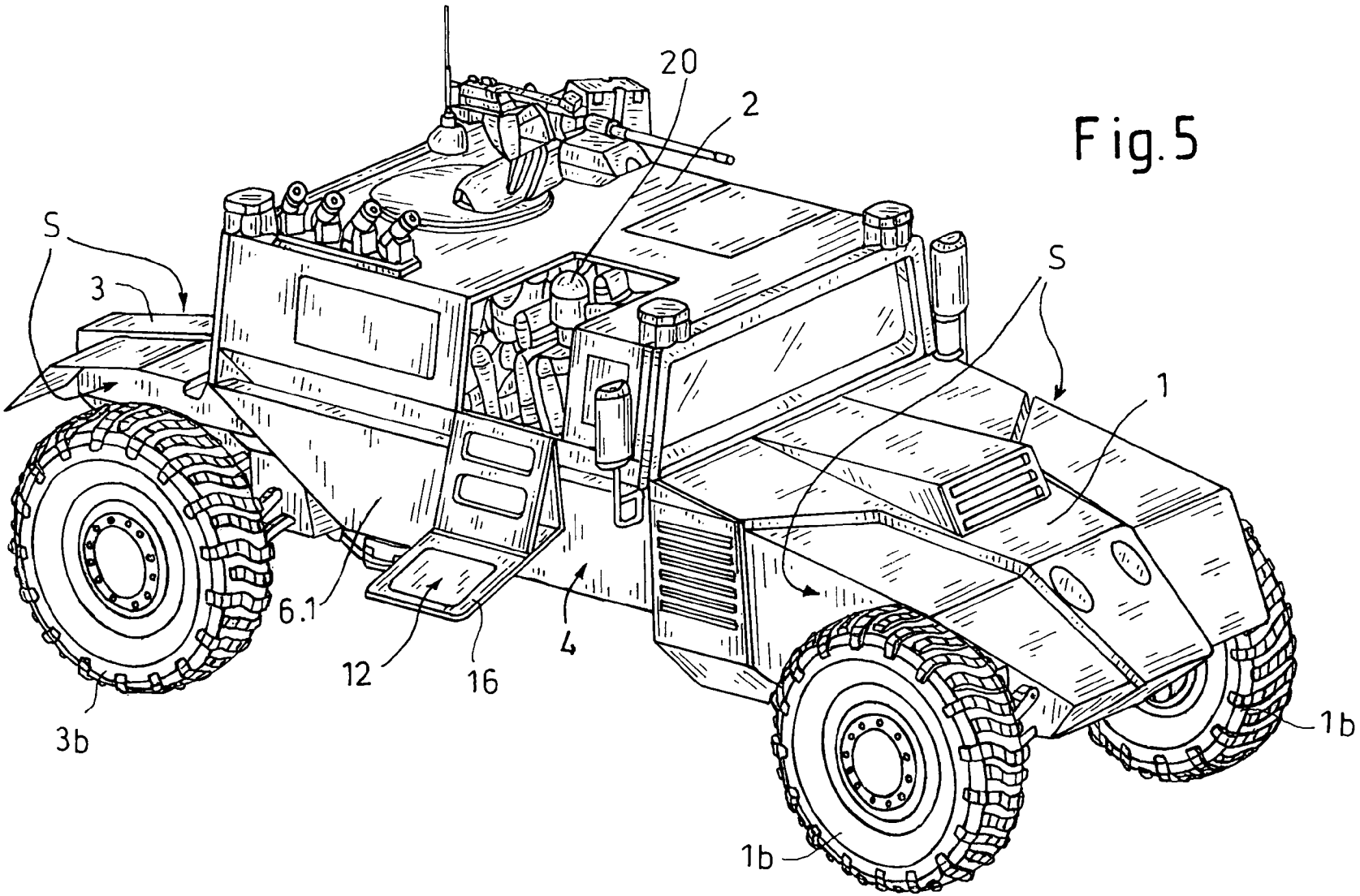
FIG. 5 is a prospective view of an exemplary vehicle embodiment in accordance with the present invention.
Figure 6:
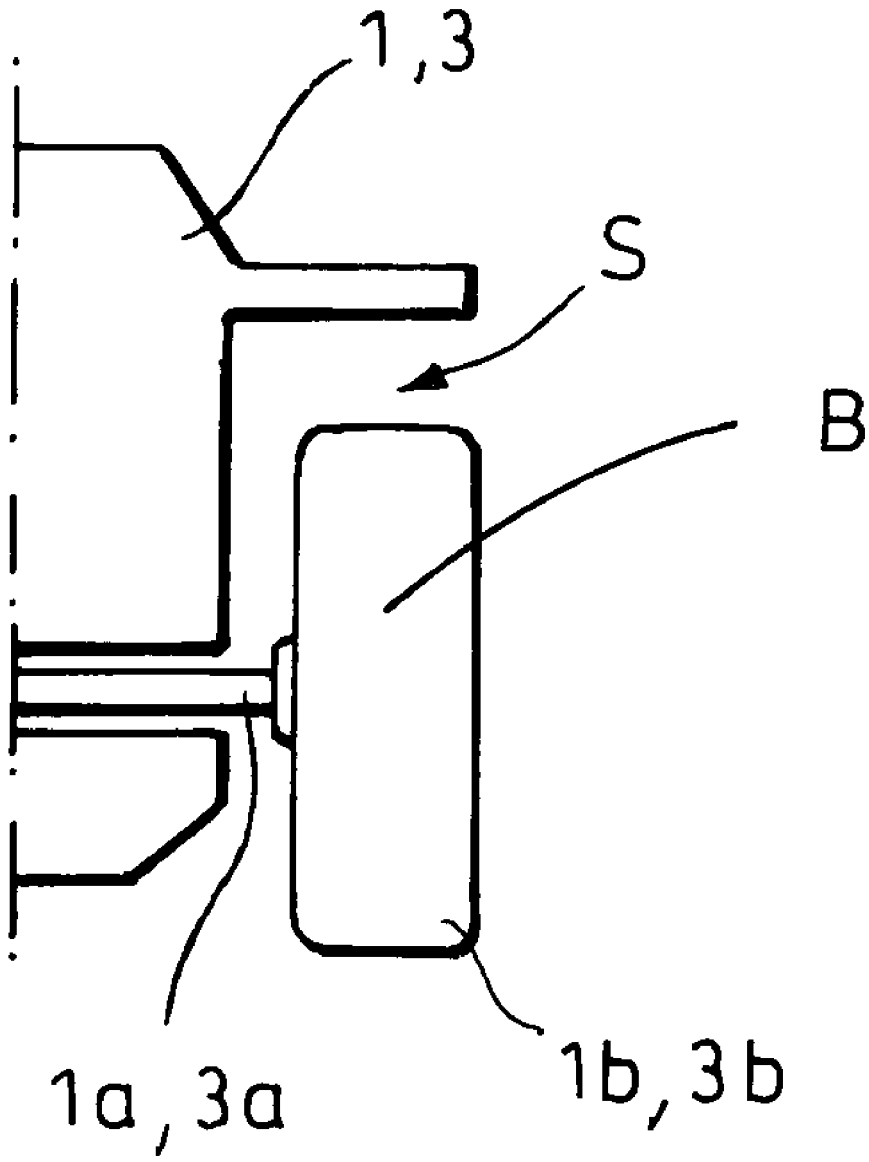
FIG. 6 is a cross sectional view of the vehicle embodiment shown in FIG. 1 taken through either line I-I or line III-III shown in FIG. 1.

Persons skilled in the art would appreciate from FIGS. 1 and 5 that the wheel axles 1*a*, 3*a* are not disposed underneath the crew space building block 2, as they typically would be in a conventional armored personnel vehicle. Near wheels 1*b*, 3*b* a free space S, such as shown in FIGS. 5 and 6, is oriented and maintained at right angles above the wheels 1*a* of the motor building block 1 and above the wheels of rear building block 3. Motor building block 1 and rear building blocks 3 are flanged onto the crew space building block 2, and preferably are releasably connected to the crew space building block by the schematically indicated bolts/exploding bolts 4*a* that provide a means for connecting, or by some other equivalent connecting member or means of connecting. The front building block 1 also includes a drive motor 1*c* operably connected to drive and rotate the front axle 1*a*, and a steering mechanism or assembly (not shown) connected to steer the wheels 1*b*. A driving motor 3*c* can also be provided in rear building block 3, wherein the driving motor 3*c* is operably connected to drive and rotate the rear axle 3*a*.

Figure 2:
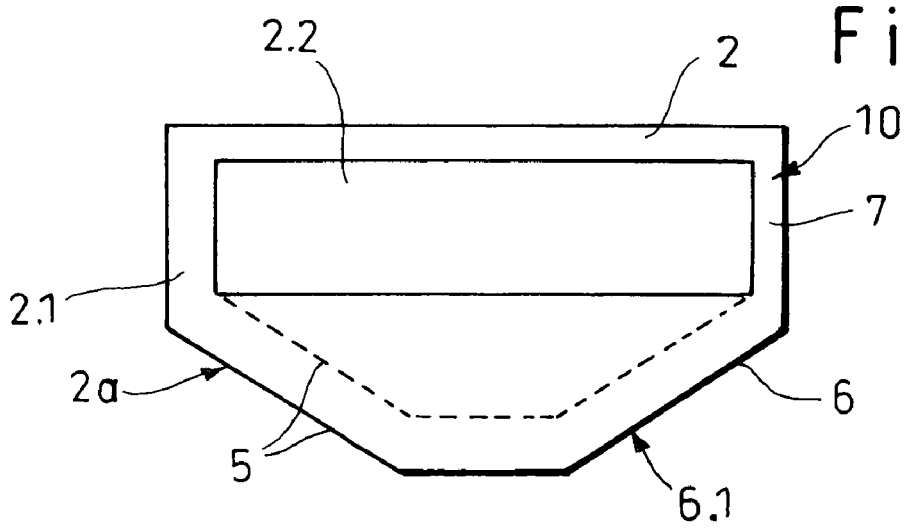
FIG. 2 is a cross sectional view of a crew security cell in accordance with the present invention.

As shown in FIG. 2, a crew space building block 2 is shown in cross section with an inclined floor 6, which has a double walled structure 5 and a high profile 7. The high profile 7 is hollow.

The crew space building block 2 includes an outer region 2.1 and an inner region 2.2. The outer region 2.1 is designed as a pan 2*a*, and is constructed to have a V-shape towards the bottom portion. The inner region 2.2 serves to define the actual crew space (i.e., the location where a crew 20 operates the vehicle 4 and is optimally protected) and is completely sealed by a cabin or security cell (9 and 11). The cabin or security cell (9 and 11) is hung on the housing portion 10 of the outer region 2.1, and is fastened on the upper edge 2.3 of the outer region 2.1.

Figure 3:
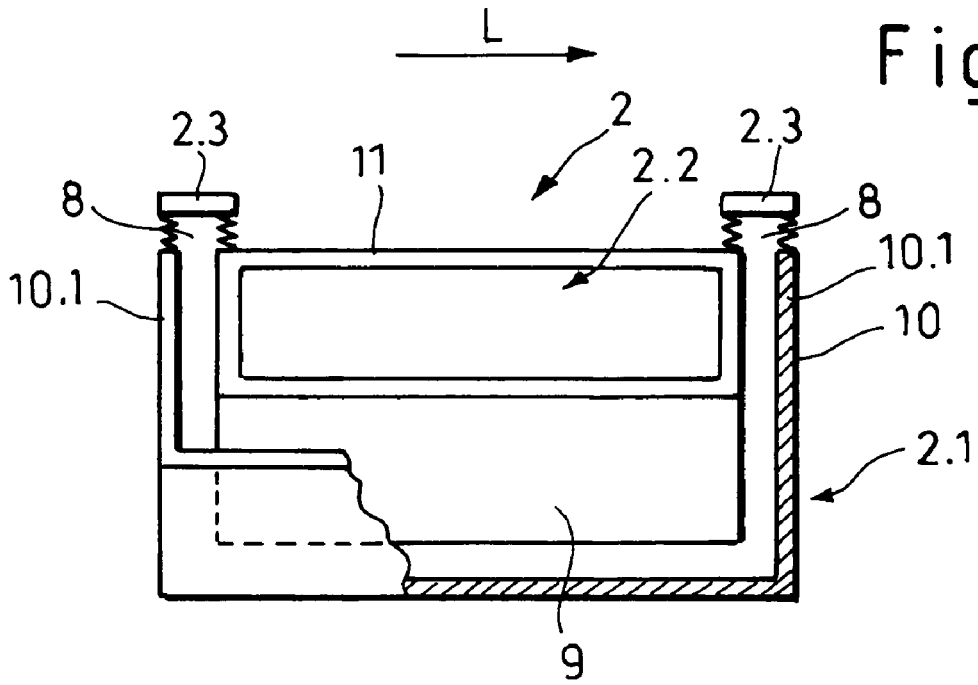
FIG. 3 is a side view of the suspended security cell.

The principle, in accordance with the present invention, of the suspended cabin or security cell (9 and 11) is shown in FIG. 3 whereby the security cell (9 and 11) is hung into the housing portion 10 by means of elastic hangers 8. The housing portion 10 preferably has a plastically deformable support structure and the material of the cabin/security cell (9 and 11) is preferably aluminum in order to catch secondary shrapnel (i.e., shrapnel originating from damaged portions of vehicle 4).

Figure 4:
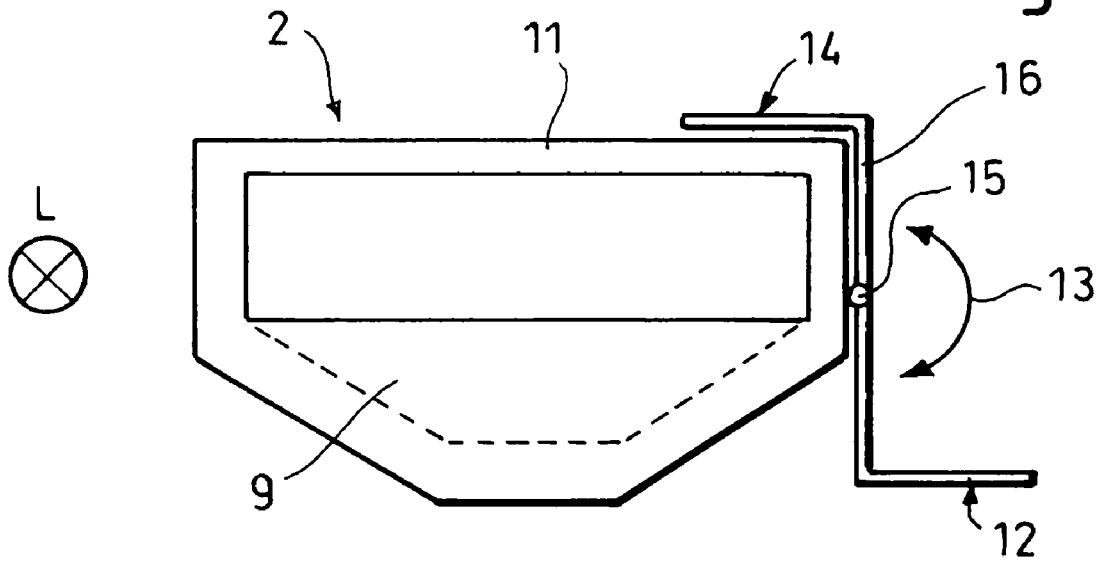
FIG. 4 is a cross sectional view of a security cell, such as shown in FIG. 2, and additionally illustrating a door in accordance with the present invention.

As shown in FIG. 4, a security cell (9 and 11) has a point shape at the bottom or lower portion 9, which corresponds to the V-shape of the pan 2*a* of the main building block 2. While FIG. 4 shows only a cross section, a person skilled in the art would realize that the correspondence in shape between the point shape of the lower portion 9 of the security cell (9 and 11) and the V-shape of the pan 2*a* actually runs lengthwise L along the length direction of the vehicle 4 (See "L" direction illustrated in FIGS. 1, 3 and 4). A vehicle door 16 is shown at an open position 12 and at a closed position 14. The door 16 is pivoted on a pivot journal or hinge 15 along a movement direction 13. The pivot journal or hinge 15 of the door 16 is disposed on the main building block 2, preferably before, or above, the diagonal portion 6.1 of the inclined floor 6.

A representative vehicle 4, according to the present invention, is shown in FIG. 5 as including a plurality of building blocks including front building block 1, main building block 2 and rear building block 3. Vehicle 4 is, for example, a military armored personnel vehicle, a humvee, a jeep, or other vehicle equipped for a military, peacekeeping or police mission.

The manner in which a mine protection vehicle system, in accordance with the present invention, provides protection from the effects of an exploding mine are described as follows. During a mine explosion, the shock wave generated by the exploding mine (not shown) first impacts against either wheel 1*b*, or wheel 3 *b*, thereby causing the wheel struck by the shock wave to separate from the vehicle 4.

Mechanisms for separating a wheel 1*b*, 3*b* from its axle 1*a*, 3*a*, respectively, in response to a mine explosion are disclosed in U.S. patent application Ser. No. 10/739,947 to Grosch (corresponding to DE 102 59 918.1), which is incorporated herein by reference in its entirety, or by Document WO 02/47958 A2. As the shock wave continues to move into the vehicle 4, the struck wheel 1*b* or 3*b*, along with its respective building block, separates from a remaining portion of the vehicle 4.

In other words, when the explosive impulse generated by an exploding mine impacts against either wheel 1*b* or wheel 3*b*, the corresponding building block 1 or 3, respectively, can separate and fly away upwardly into the free space S above the wheels. For the purposes of this disclosure, the free space S is created, in part, by providing higher placed wheel boxes or by excluding the wheel boxes altogether from the structure of the vehicle 4. An illustrative example of free space S located 90° upwards (i.e., above) of the wheel 1*b*, 3*b* of axle 1*a*, 1*b*, provided in accordance with the present invention, is shown in FIG. 6. Space S in FIG. 6 is created by excluding a conventional wheel housing from the building block 1, 3 construction. Space S permits the wheel 1*b*, 3*b* to be blown off in the direction indicated by arrow B. Thus, a wheel 1*b*, 3*b* can be blown off and fly away from the vehicle 4 without getting caught up in a wheel housing or a wheel box.

To provide additional protection from mine explosions, mechanisms for separating a wheel during a mine explosion can be used in combination with the structure disclosed above for separating a building block 1, 3 from the remainder of the vehicle 4. Thus, the entire building block, either 1 or 3, can also be ripped off or be blown off from the remaining portion of the vehicle 4, a process that is facilitated by the bolts 4*a* that are provided with target break points and/or a built-in explosive charge for igniting and blowing off the bolt.

In the manner just described, the entire axle 1*a* and drive 1*c* of the vehicle 4 can be separated from the remaining portion of the vehicle without hitting against the bottom of main building block 2 because the building blocks 1, 2, 3 are constructed with vertical separation lines (See lines X-X in FIG. 1). Subsequently, the remaining impulse energy from the mine explosion that thereafter flows into the middle main building block 2 is transformed, and dissipated, into deformation energy by the double walled construction of the lower portion 9 of the cabin (9 and 11). Thereafter, the remaining impulse is transmitted, or moves, to strike the thin walled supports 10.1 in the upper region or portion of the building block 2. When the explosive impulse strikes the thin-walled supports 10.1, they compress together or contract. Lastly, any residual energy from the explosive impulse strikes, or is transmitted to, the elastic support or hangers 8 in the roof 11 of the cabin (9 and 11). At this point in the movement of the explosive impulse through the vehicle 4, the impulse wave has become so long and flat that mechanical springs, or the like, can be used to dissipate the remaining energy.

Thus, the remaining impulse energy that flows over these springs into the roof 11 of the cabin (9 and 11) is sufficiently dampened that it no longer significantly injures the crew 20. Advantageously, by means of the remaining drive 3*c*, in the case where the motor building block 1 is blown off, the crew of the vehicle 4 can drive the surviving portion of the vehicle out of the danger zone and into safety. In the case where it is the rear building block 3 that is blown off the vehicle 4, the crew would operate the remaining drive 1*c* of motor building block 1 to drive the surviving portion of the vehicle 4 out of the danger zone and into safety.

Furthermore, persons of ordinary skill in the art would realize that the mine protection vehicle system illustratively described above is a combination of various protective features that apply different principles to solving the problem of protecting a crew in a vehicle from the damaging effects of a blast wave from an exploding mine. Thus, it is within the spirit and scope of the present invention to add supplemental characteristics to the construction of the mine protection vehicle system, such as to apply a V-form or shape to the configuration of the support structure, to enhance the thick walled structure of the cabin by using a thick walled, relatively soft, aluminum material for absorbing shock wave energy, and the possibility of constructing redundant drive building blocks (i.e., to build a mutli-axled vehicle having 3-axles, or 4-axles, or 5-axles and so on with a corresponding number of drive building blocks, or one or more axle per drive building block). In this context, a "drive building block" is any building block that has a axle connected to rotate thereon and a drive motor connected to rotate the axle. In addition, it should be understood that it is within the spirit and scope of the present invention to provide the front and/or rear building blocks 1, 3 with slanted bottoms that geometrically correspond to the shape of diagonal floor 6 of the main building block 2.

While the present invention has been described with reference to certain illustrative embodiments, one of ordinary skill in the art will recognize that additions, deletions, substitutions, modifications and improvements can be made while remaining within the scope and spirit of the present invention as defined by the appended claims.

REFERENCE NUMERAL LIST

1—Front or Motor Building Block;
1*a*—Wheel Axel;
1*b*—Wheel;
2-Main Building Block, Crew Space Building Block;
2.1—Outer Region;
2.2—Inner Region;
2*a*—Pan;
3—Rear Building Block;
3*a*—Wheel Axel;
3*b*—Wheel;
4—Vehicle;
4*a*—Bolt/Exploding Bolt;
5—Double Walled Floor;
6—Diagonal Floor;
7—High Profile;
8—Elastic Hanger;
9—Lower Portion of Security Cell;
10—Housing Portion;
11—Upper Portion or Roof of Security Cell cabin;
12—Door at Closed Position;
13—Direction of Movement of Door;
14—Door at -Open Position;
15—Pivoting Journal or Hinge;
16—Door.

What is claimed is:

1. An armored wheeled vehicle with protection against effects of a land mine, comprising:

(a) a plurality of building blocks separating and dividing the vehicle, wherein the plurality of building blocks include:

i. at least one main building block, wherein the main building block has a V-shaped floor;

ii. a front building block, wherein the front building block comprises a front wheel axle connected to rotate on the front building block, a steering assembly connected to steer wheels connected to the front wheel axle, and a first drive motor operably connected to drive the front wheel axle; and iii. a rear building block, wherein the rear building block comprises a rear wheel axle connected to rotate on the rear building block and a second drive motor operably connected to drive the rear wheel axle, wherein the front building block is separably connected by a first means for connecting to a front portion of the main building block and the rear building block is separably connected by a second means for connecting to a rear portion of the main building block, wherein the first means for connecting and the second means for connecting each comprise one or more bolts having target break points or one or more exploding bolts, each exploding bolt comprising a built-in charge for igniting and blowing off the bolt; and (b) a plurality of wheel axles disposed to rotate on one or more of the plurality of building blocks, wherein no wheel axle is disposed below the main building block, wherein the plurality of wheel axles includes the front wheel axle and the rear wheel axle, and wherein after one of the front building block and first drive motor or the rear building block and second drive motor is separated from the main building block, a surviving portion of the armored wheeled vehicle comprising the main building block that remains connected to the second drive motor or the first drive motor, respectively, has substantial mobility provided by the remaining drive motor.

2. A vehicle according to claim 1, further comprising a plurality of wheels connected to each wheel axle, wherein the vehicle is constructed so a free space is located at 90° upwards, above the wheels of each wheel axle.

3. A vehicle according to claim 1, wherein the main building block comprises a pan housing, and the pan housing comprises a double walled structure and a thin steel plate.

4. A vehicle according to claim 3, wherein the pan housing further comprises a high profile.

5. A vehicle according to claim 1, wherein the main building block comprises a first cabin hung into, and vibrationally decoupled to, a housing portion by a plurality of elastic hangers.

6. A vehicle according to claim 5, wherein the housing portion comprises a plastically deformable carrier support structure.

7. A vehicle according to claim 5, wherein the vehicle is reconfigureable by unhanging the first cabin and hanging in a second cabin in place of the first cabin thereby reconfiguring the vehicle.

8. A vehicle according to claim 1, wherein the main building block comprises one or more first doors, wherein each first door is flapped down in an open position to provide a step support.

9. A vehicle according to claim 1, wherein while the front building block and the rear building block are connected to the main building block, the first drive motor and the second drive motor are operable at the same time to drive the vehicle.

10. A vehicle according to claim 1, wherein the substantial mobility provided by the remaining drive motor is sufficient to drive the surviving portion to safety out of a danger zone.

11. An armored wheeled vehicle with protection against effects of a land mine, comprising:

(a) a plurality of building blocks separating and dividing the vehicle, wherein the plurality of building blocks include:

i. at least one main building block, wherein the main building block comprises a first cabin hung into, and vibrationally decoupled to, a housing portion by a plurality of elastic hangers, and the first cabin comprises thick walled soft aluminum material, and a first space for a drive shaft or for cables is constructed inside the main building block, wherein the first space is located between a V-shaped floor of a support structure of the main building block and a flat bottomed portion of the first cabin;

ii. a front building block, wherein the front building block comprises a front wheel axle connected to rotate on the front building block, a steering assembly connected to steer wheels connected to the front wheel axle, and a first drive motor operably connected to drive the front wheel axle; and iii. a rear building block, wherein the rear building block comprises a rear wheel axle connected to rotate on the rear building block and a second drive motor operably connected to drive the rear wheel axle, wherein the front building block is separably connected by a first means for connecting to a front portion of the main building block and the rear building block is separably connected by a second means for connecting to a rear portion of the main building block, wherein the first means for connecting and the second means for connecting each comprise one or more bolts having target break points or one or more exploding bolts, each exploding bolt comprising a built-in charge for igniting and blowing off the bolt; and (b) a plurality of wheel axles disposed to rotate on one or more of the plurality of building blocks, wherein no wheel axle is disposed below the main building block, wherein the plurality of wheel axles includes the front wheel axle and the rear wheel axle, and wherein after one of the front building block and first drive motor or the rear building block and second drive motor is separated from the main building block, a portion of the armored wheeled vehicle comprising the main building block that remains connected to the second drive motor or the first drive motor, respectively, has substantial mobility provided by the remaining drive motor.

12. An armored wheeled vehicle with protection against effects of a land mine, comprising:

(a) a plurality of building blocks separating and dividing the vehicle, wherein the plurality of building blocks include:

i. at least one main building block, wherein the main building block comprises a first cabin hung into, and vibrationally decoupled to, a housing portion by a plurality of elastic hangers, and the first cabin comprises thick walled soft aluminum material, wherein the main building block has a V-shaped floor and the housing portion comprises a plastically deformable carrier support structure that includes two thin walled collapsible or contractable supports, and the main building block further comprises a pan housing, and the pan housing comprises a double walled structure and a thin steel plate, and a first space for a drive shaft or for cables is constructed inside the main building block, wherein the first space is located between the V-shaped floor of the main building block and a flat bottomed portion of the first cabin;

ii. a front building block, wherein the front building block comprises a front wheel axle connected to rotate on the front building block, a steering assembly connected to steer wheels connected to the front wheel axle, and a first drive motor operably connected to drive the front wheel axle; and iii. a rear building block, wherein the rear building block comprises a rear wheel axle connected to rotate on the rear building block and a second drive motor operably connected to drive the rear wheel axle, wherein the front building block is separably connected by a first means for connecting to a front portion of the main building block and the rear building block is separably connected by a second means for connecting to a rear portion of the main building block, wherein the first means for connecting and the second means for connecting each comprise one or more bolts having target break points or one or more exploding bolts, each exploding bolt comprising a built-in charge for igniting and blowing off the bolt; and (b) a plurality of wheel axles disposed to rotate on one or more of the plurality of building blocks, wherein no wheel axle is disposed below the main building block, wherein the plurality of wheel axles includes the front wheel axle and the rear wheel axle, and wherein after one of the front building block and first drive motor or the rear building block and second drive motor is separated from the main building block, a portion of the armored wheeled vehicle comprising the main building block that remains connected to the second drive motor or the first drive motor, respectively, has substantial mobility provided by the remaining drive motor, wherein the main building block further comprises one or more first doors, wherein each first door is flapped down in an open position to provide a step support.

* * * * *